US009890001B2

(12) United States Patent
Taniguchi et al.

(10) Patent No.: US 9,890,001 B2
(45) Date of Patent: Feb. 13, 2018

(54) SHEET FEEDING APPARATUS AND PRINTING APPARATUS

(71) Applicant: CANON KABUSHIKI KAISHA, Tokyo (JP)

(72) Inventors: Hisashi Taniguchi, Yokohama (JP); Yasuyuki Hirai, Yokohama (JP); Yasuyuki Asai, Tokyo (JP); Motoyuki Taguchi, Komae (JP); Atsushi Ikeda, Yokohama (JP); Kyoshiro Okude, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/828,650

(22) Filed: Aug. 18, 2015

(65) Prior Publication Data

US 2016/0052733 A1 Feb. 25, 2016

(30) Foreign Application Priority Data

Aug. 25, 2014 (JP) ..... 2014-170342

(51) Int. Cl.

| | |
|---|---|
| ***B65H 3/06*** | (2006.01) |
| ***B65H 3/24*** | (2006.01) |
| ***B65H 3/40*** | (2006.01) |
| ***B65H 3/46*** | (2006.01) |
| ***B65H 3/56*** | (2006.01) |

(Continued)

(52) U.S. Cl.

CPC ..... *B65H 3/0684* (2013.01); *B65H 1/266* (2013.01); *B65H 3/06* (2013.01); *B65H 3/24* (2013.01); *B65H 3/40* (2013.01); *B65H 3/56* (2013.01); *B65H 5/06* (2013.01); *B65H 7/00* (2013.01); *B65H 7/18* (2013.01); *B65H 2403/512* (2013.01); *B65H 2404/5213* (2013.01);

(Continued)

(58) Field of Classification Search

CPC ..... B41J 13/103; B41J 11/0035; B65H 5/006; B65H 5/06

See application file for complete search history.

(56) References Cited

U.S. PATENT DOCUMENTS 6,331,002 B1 12/2001 Yoshino et al.
6,824,132 B2 11/2004 Asai et al.

(Continued)

FOREIGN PATENT DOCUMENTS

JP 2011-148622 A 8/2011

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A sheet feeding apparatus includes a feeding unit, a separation surface, a first separation part configured to switch between a condition in which the first separation part is protruded from the separate surface and the sheet comes into contact with the first separation part and a condition in which the first separation part is retracted from the separate surface and the sheet does not come into contact with the first separation part and to be fixed to each of the two conditions and a second separation part configured to be movable in a direction from a condition in which the second separation part is protruded from the separate surface and the sheet is capable of come into contact with the second separation part to a condition in which the second separation part is retracted from the separate surface, according to a contact force received from the sheet.

8 Claims, 17 Drawing Sheets

(51) Int. Cl.

| | |
|---|---|
| ***B65H 5/06*** | (2006.01) |
| ***B65H 7/18*** | (2006.01) |
| ***B65H 1/26*** | (2006.01) |
| ***B65H 7/00*** | (2006.01) |

(52) U.S. Cl.
CPC .. *B65H 2405/1134* (2013.01); *B65H 2511/20* (2013.01); *B65H 2515/81* (2013.01)

(56) References Cited

U.S. PATENT DOCUMENTS

| | | | | |
|---|---|---|---|---|
| 8,141,866 | B2 | 3/2012 | Okawa et al. | |
| 8,636,278 | B2 | 1/2014 | Emoto et al. | |
| 8,807,556 | B2 | 8/2014 | Sugiyama et al. | |
| 2003/0107780 | A1* | 6/2003 | Kang | H04N 1/00567 358/498 |
| 2005/0017429 | A1* | 1/2005 | Park | B65H 1/04 271/8.1 |
| 2007/0253037 | A1* | 11/2007 | Mo | B65H 3/56 358/498 |
| 2008/0290585 | A1* | 11/2008 | Asada | B65H 3/0684 271/10.09 |
| 2011/0127713 | A1* | 6/2011 | Emoto | B65H 3/0684 271/147 |

* cited by examiner

SHEET FEEDING APPARATUS AND PRINTING APPARATUS

BACKGROUND OF THE INVENTION

Field of the Invention

The present invention relates to a sheet feeding apparatus and a printing apparatus, and more specifically, to a technique for performing sheet feeding by separating stacked sheets from one another using a plurality of separation parts that apply different levels of resistance to fed sheets.

Description of the Related Art

Sheets used for printing apparatuses such as printers, copy machines, and facsimile machines range from low-rigidity sheets such as plain paper to high-rigidity sheets such as photo paper and postcards. A sheet feeding apparatus has been desired which appropriately feeds such a variety of sheets. Japanese Patent Laid-Open No. 2011-148622 discloses a sheet feeding apparatus that performs sheet feeding by separating sheets from one another using a plurality of separation parts that apply different levels of resistance to fed sheets. More specifically, the sheet feeding apparatus includes the separation parts that are movable with respect to a fixed separation slope and that apply the different levels of resistance based on biasing by springs. When one of the high-rigidity sheets is separated from the other sheets, both the separation part with lower resistance and the separation part with higher resistance are pushed in by the feeding of the sheet and sink into the fixed separation slope, which then allows the sheet to be separated. In this feeding configuration, in particular, when one of the high-rigidity sheets is separated from the other sheets and fed, a load on the sheet is reduced to enable the sheet to be appropriately fed.

However, in the sheet feeding apparatus disclosed in Japanese Patent Laid-Open No. 2011-148622, when a bundle of plurality of low-rigidity sheets enters the separation slope, the plurality of separation parts is pushed in against the force of the bias member and sinks into the fixed separation slopes. Thus, even the lower-rigidity sheet is separated by the fixed separation slope, resistance needed for the desired separation fails to be applied to the sheet, resulting in overlap feeding.

SUMMARY OF THE INVENTION

An object of the present invention is to provide a sheet feeding apparatus and a printing apparatus that enable sheets with different levels of rigidity to be individually reliably separated from one another and fed.

In a first aspect of the present invention, there is provided a sheet feeding apparatus comprising: a feeding unit configured to feed a sheet by coming into contact with an uppermost sheet of a plurality of stacked sheets; a separation surface being used for separating the sheet fed by the feeding unit; a first separation part that is provide on a part of the separate surface and is configured to switch between a condition in which the first separation part is protruded from the separate surface and the sheet is capable of come into contact with the first separation part and a condition in which the first separation part is retracted from the separate surface and the sheet is not capable of come into contact with the first separation part and to be fixed to each of the two conditions; and a second separation part that is provide on a part of the separate surface and is configured to be movable in a direction from a condition in which the second separation part is protruded from the separate surface and the sheet is capable of come into contact with the second separation part to a condition in which the second separation part is retracted from the separate surface, according to a contact force received from the sheet.

In a second aspect of the present invention, there is provided a printing apparatus comprising: a feeding unit configured to feed a sheet by coming into contact with an uppermost sheet of a plurality of stacked sheets; a separation surface being used for separating the sheet fed by the feeding unit; a first separation part that is provide on a part of the separate surface and is configured to switch between a condition in which the first separation part is protruded from the separate surface and the sheet is capable of come into contact with the first separation part and a condition in which the first separation part is retracted from the separate surface and the sheet is not capable of come into contact with the first separation part and to be fixed to each of the two conditions; a second separation part that is provide on a part of the separate surface and is configured to be movable in a direction from a condition in which the second separation part is protruded from the separate surface and the sheet is capable of come into contact with the second separation part to a condition in which the second separation part is retracted from the separate surface, according to a contact force received from the sheet; and a printing unit configured to perform printing to the fed sheet.

The above-described configuration enables sheets with different levels of rigidity to be individually reliably separated from one another and fed.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

Figure 1A:
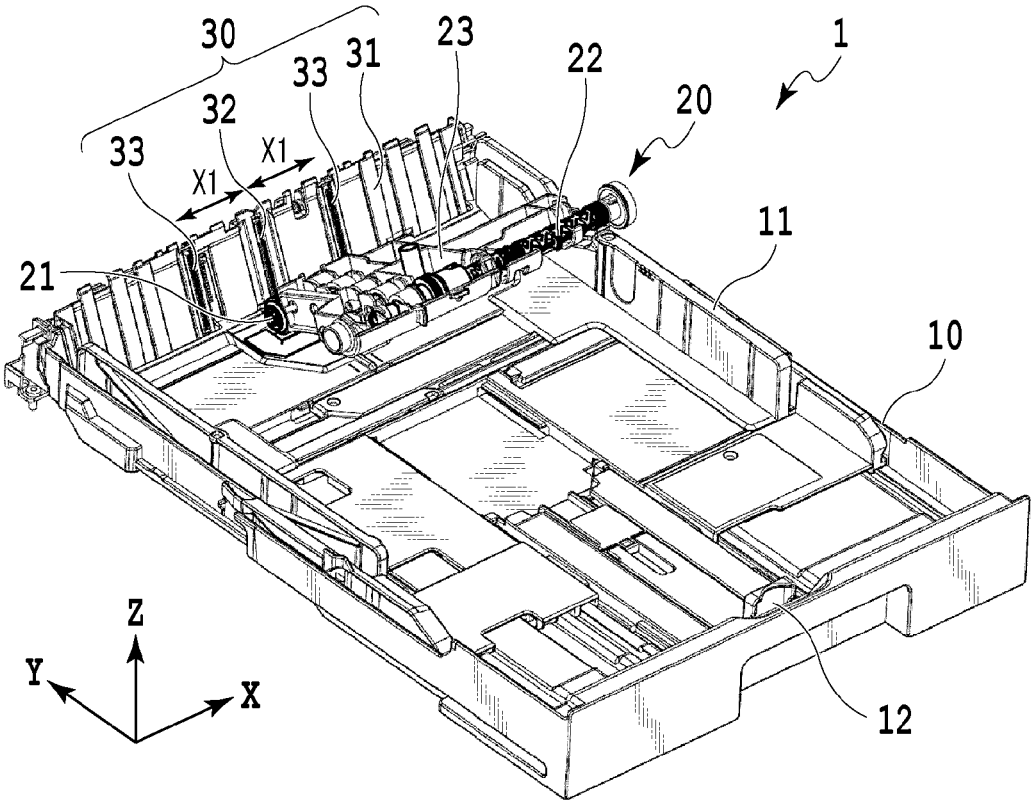
FIG. 1A is a perspective view showing a sheet feeding apparatus according to an embodiment of the present invention.
Figure 1B:
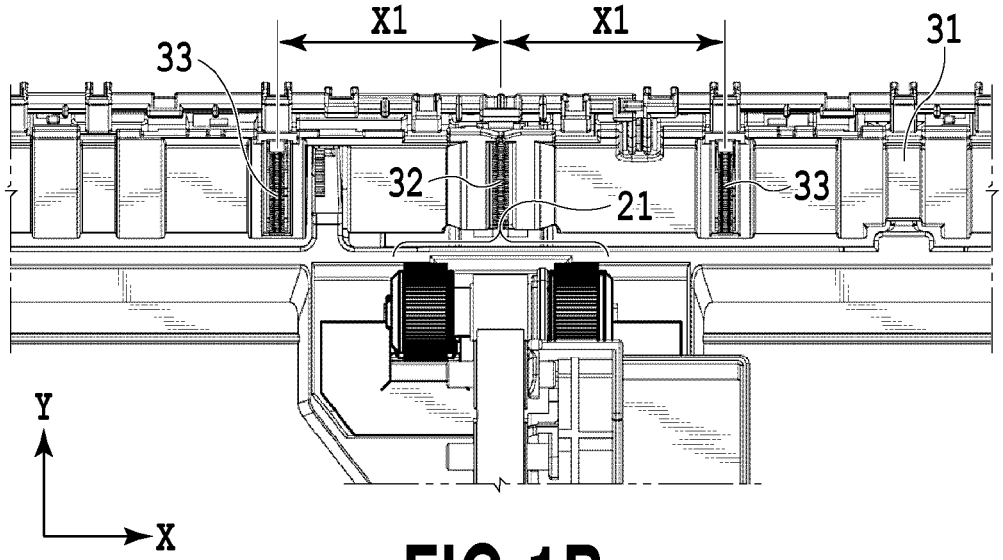
FIG. 1B is a top view showing a sheet feeding section of the sheet feeding apparatus.
Figure 2:
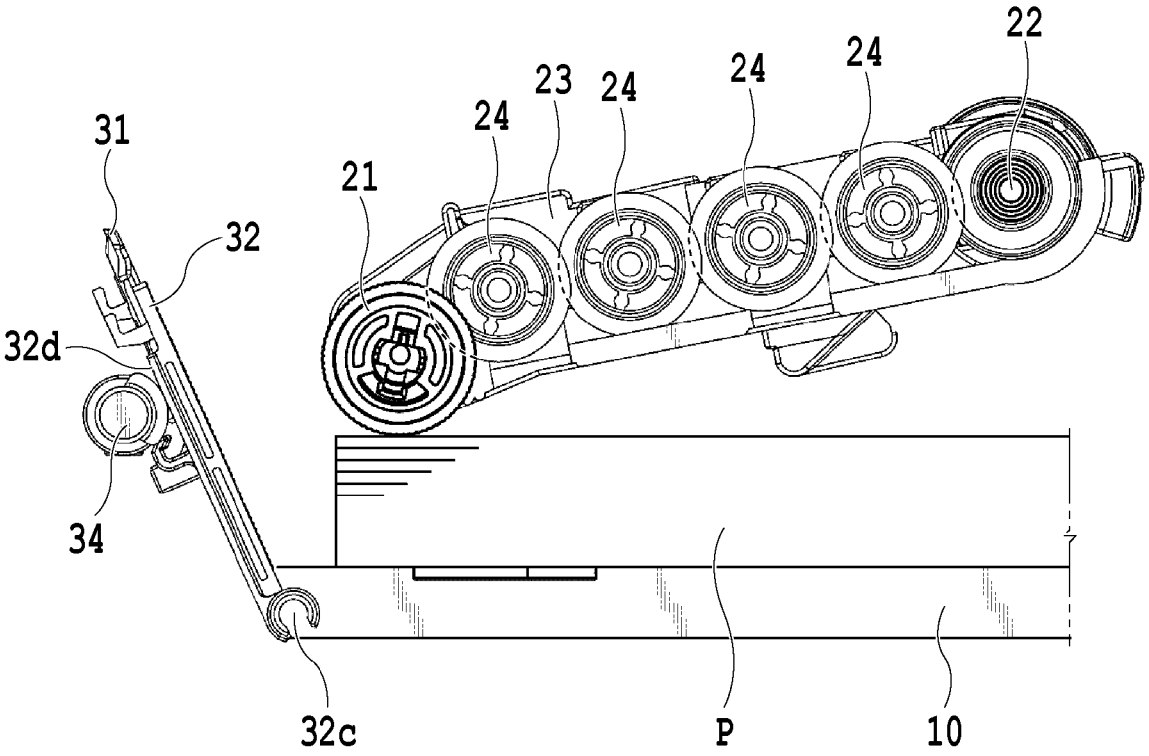
FIG. 2 is a sectional view of the sheet feeding section shown in FIG. 1B.

FIG. 1A is a perspective view showing a sheet feeding apparatus according to an embodiment of the present invention. FIG. 1B is a top view showing a sheet feeding section of the sheet feeding apparatus. FIG. 2 is a sectional view showing the sheet feeding section.

As shown in FIG. 1A, a sheet feeding apparatus 1 according to the present embodiment includes a cassette 10 in which a plurality of sheets P can be housed so as to be stacked, a pickup roller unit 20 that allows the sheet P to be picked up, and a separation section 30 that allows the uppermost one of the sheets P to be separated from the other sheets and fed. The cassette 10 is provided with a lateral pair of side guides 11 that allows the sheets P to be held so as to align side surfaces of the sheets P with one another. The side guides 11 are configured such that the right and left side guides (11*b* and 11*a*) are movable in conjunction with each other. The side guides 11 are also configured so as to fix the center of the sheets P in a width direction (an X direction in FIG. 1A). An end guide 12 is also provided to hold the sheets P so as to align trailing ends of the sheets P (an upstream side in a conveying direction).

The pickup roller unit 20 is provided above the cassette 10. The pickup roller unit 20 includes a pickup arm 23 and a drive shaft 22. The pickup arm 23 is provided so as to be rotatable around the drive shaft 22 and can thus pivot to a position according to the stacking height of the sheets P. A pickup roller 21 is provided at a leading end of the pickup arm 23 to allow the uppermost sheet P to be fed. The pickup roller 21 can be rotated by a driving force transmitted from a driving source not shown in the drawings, via the drive shaft 22 and an idler gear 24. The pickup arm 23 is provided with a bias member not shown in the drawings, and the bias member allows the pickup roller 21 to be pressed against the sheet P at a predetermined bias force in a standby state. The pickup roller 21 is provided so as to come into abutting contact with the fed sheet at the center thereof in the width direction.

The separation section 30 is provided on a downstream side of the cassette 10 in a sheet feeding direction. The separation section 30 is provided with a separation slope (separation surface) 31 and a main separation part 32 that lies opposite to the pickup roller 21 and that corresponds to a central portion of the sheet in the width direction, the main separation part 32 being a part of the separation slope 31. In the areas of the separation section 30 that are different from the area opposite to the pickup roller 21, sub separation parts 33 are provided on the right and left of the main separation part 32 at a predetermined distance X1 from the main separation part 32 such that the sub separation parts 33 are symmetric with respect to the main separation part 32. The separation slope 31 is disposed at an obtuse angle to a +Y direction in FIG. 2 to allow a predetermined separating resistance to be applied to the sheet P. The separation slope 31 is set at an angle of 60 to 70 degrees to the +Y direction.

Figure 3:
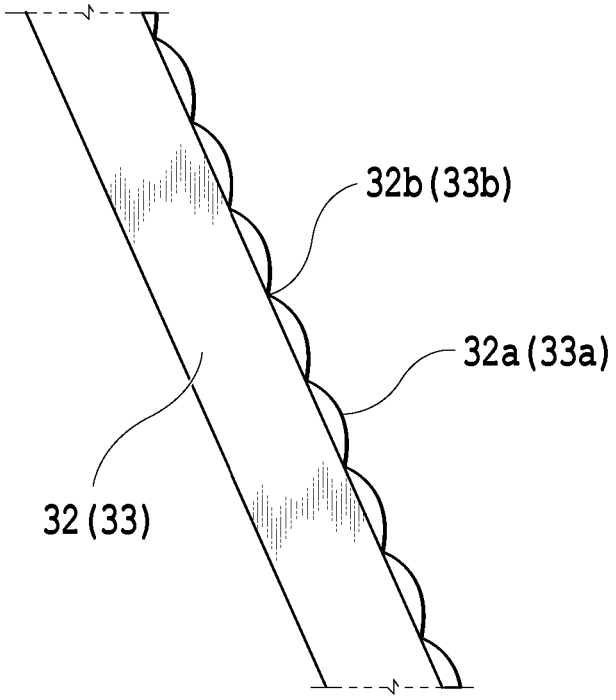
FIG. 3 is a schematic sectional view showing circular-arc-shaped protruding portions formed on upper surfaces of a main separation part and sub separation parts in the sheet feeding apparatus according to the embodiment of the present invention.
Figure 4A:
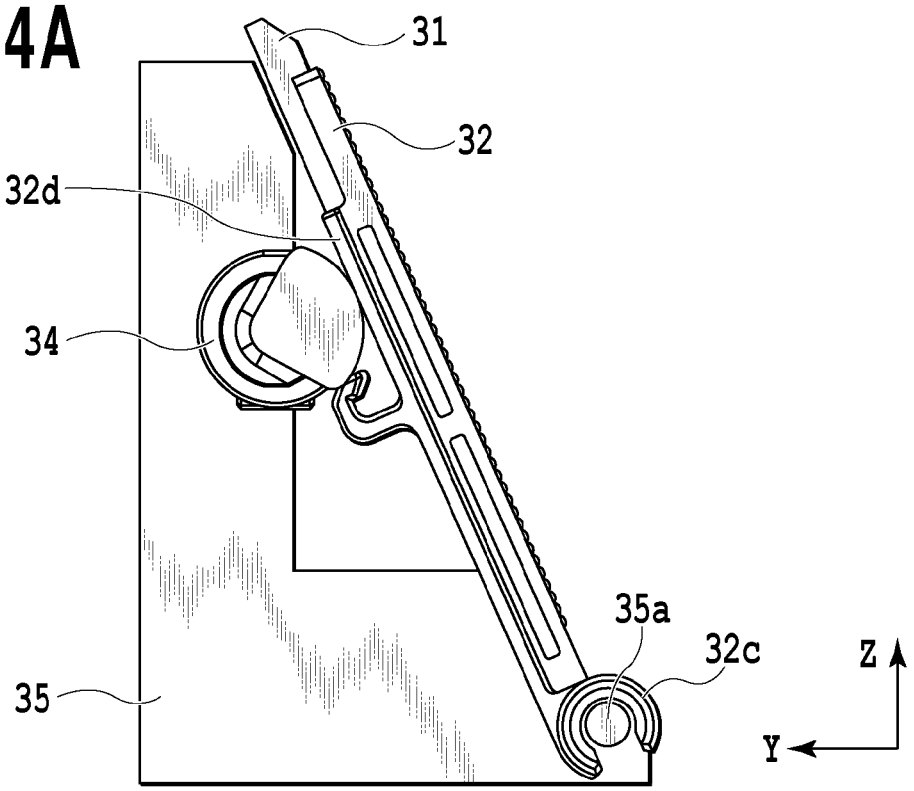
FIGS. 4A and 4B are schematic sectional view showing positions selectively taken by the main separation part according to the embodiment of the present invention, FIG. 4A showing a position where the main separation part protrudes from a separation slope and FIG. 4B showing a position where the main separation part retracts from the separation slope.
Figure 4B:
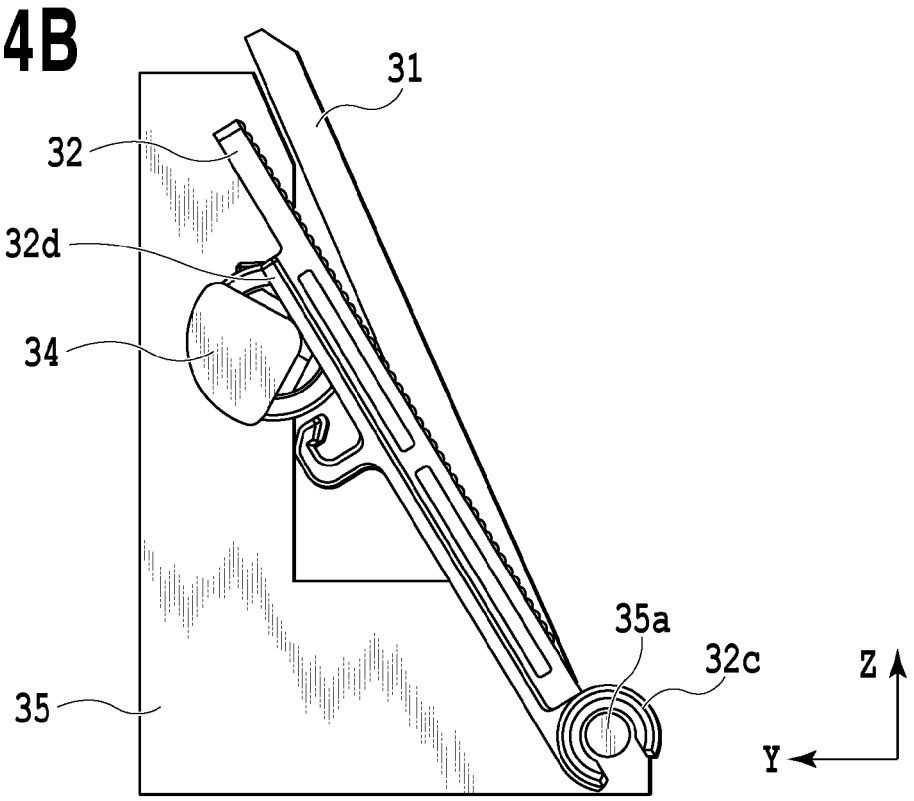
Figure 5A:
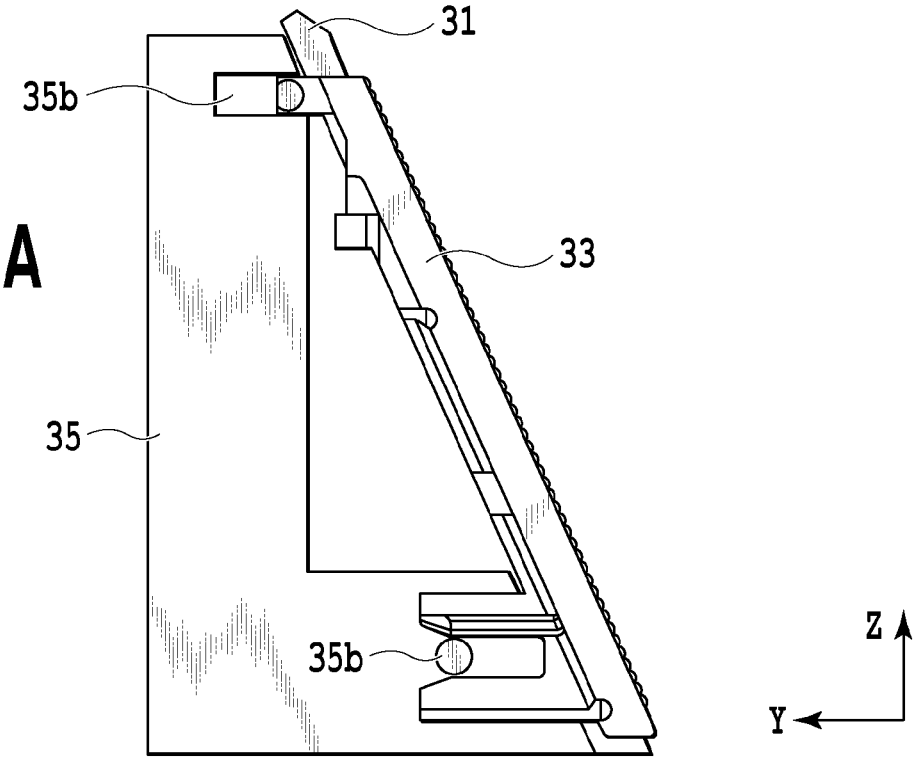
FIGS. 5A and 5B are schematic sectional views of positions to which the sub separation parts can be moved by a bias force, FIG. 5A showing a position where the sub separation parts protrude from the separation slope and FIG. 5B showing a position where the sub separation parts are pushed in by sheets.
Figure 5B:
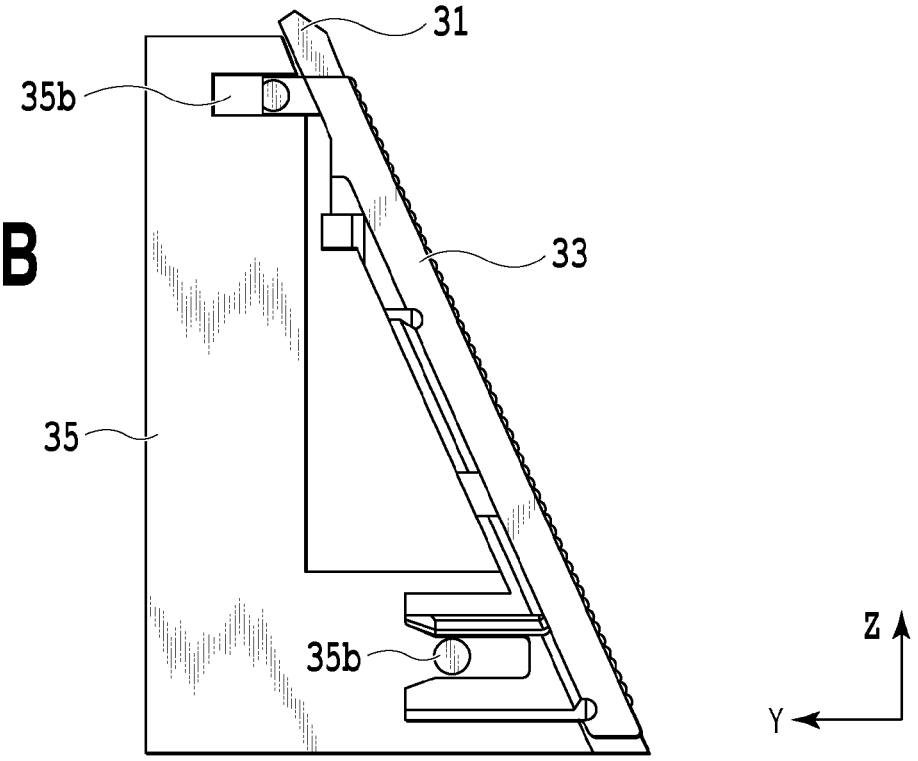

Like the separation slope 31, the main separation part 32 and the sub separation parts 33 are disposed at an obtuse angle to the Y direction in FIG. 2. On upper surfaces of the main separation part 32 and the sub separation parts 33, a plurality of circular-arc-shaped protruding portions 32*a* and 33*a* are formed which are contiguously disposed at a predetermined pitch in a conveying direction on the upper surface as shown in FIG. 3. Valley portions 32*b* and 33*b* are each formed between the protruding portions 32*a* and 33*a*. The main separation part 32 includes a fixed end 32*c* fixed to a shaft portion 35*a* of a separation slope base 35 so that the fixed end 32*c* can pivot as shown in FIGS. 4A and 4B. A cam follower 32*d* is provided on a rear surface (opposite to the protruding portions 32*a*) of the main separation part 32. A cam shaft 34 is rotationally driven to allow the orientation of the main separation part 32 to be changed. That is, the main separation part 32 is configured so as to be able to selectively take a position (position A) where the main separation part 32 protrudes from the separation slope 31 so as to enable the sheet to come into abutting contact with the main separation part 32 as shown in FIG. 4A and a position (position B) where the main separation part 32 retracts from the separation slope 31 so as to preclude the sheet from coming into abutting contact with the main separation part 32 as shown in FIG. 4B. On the other hand, the sub separation parts 33 is configured so as to be movable in the Y direction along a guide portion 35*b* formed in the separation slope base 35 as shown in FIGS. 5A and 5B. More specifically, a bias force applied, in the Y direction in the figures, by the bias member not shown in the drawings allows the sub separation parts 33 to be biased to a position where the sub separation parts 33 protrude from the separation slope 31 in the standby state. The amount by which the sub separation parts 33 protrude at this time is the same as the amount by which the main separation part 32 protrudes. The bias force applied to the sub separation parts 33 in a −Y direction in the figures is set equal to the separating resistance to be applied to the sheet P being conveyed. That is, when the low-rigidity sheet P is conveyed, the sub separation parts 33 are positioned to protrude from the separation slope 31 as shown in FIG. 5A. The bias force is also set as follows. In contrast, when a high-rigidity sheet is conveyed, the sub separation parts 33 are pushed in but are positioned to be able to cooperate with the separation slope 31 in applying resistance to the sheet as shown in FIG. 5B.

Figure 6:
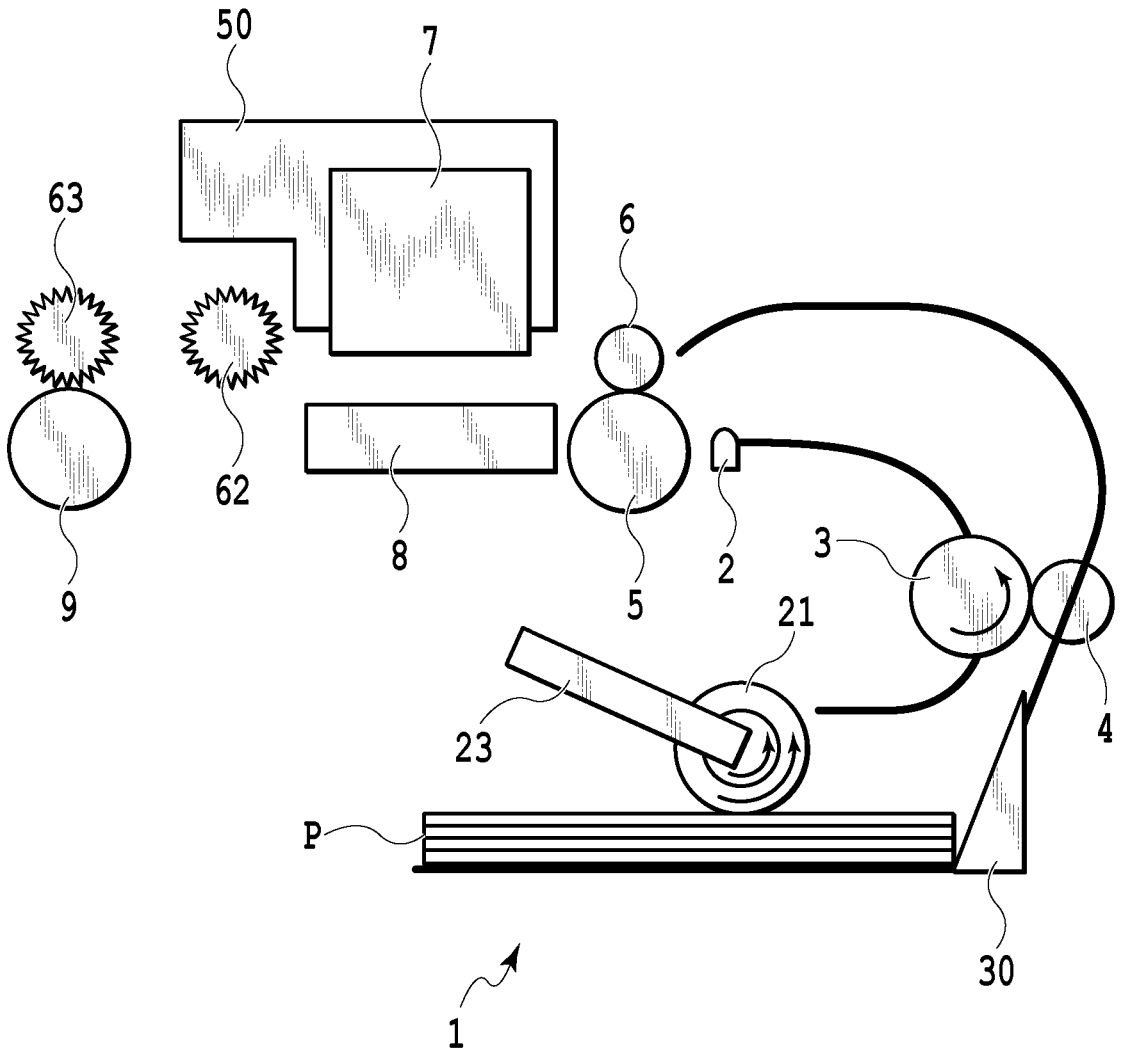
FIG. 6 is a sectional view showing a general configuration of a printing apparatus with the sheet feeding apparatus according to the embodiment of the present invention mounted therein.

FIG. 6 is a sectional view showing a general configuration of the printing apparatus with the sheet feeding apparatus 1 according to the present embodiment mounted therein. In FIG. 6, a feeding roller 3 feeds the sheet P downstream in the sheet conveying direction, which has been separated from the other sheets and fed by the sheet feeding apparatus 1. A feeding driven roller 4 applies a bias force toward the feeding roller 3 and sandwiches the sheet P between the feeding driven roller 4 and the feeding roller 3 to generate a feeding force. A sheet detection sensor 2 detects the leading end of the fed sheet P. A conveying roller 5 conveys the sheet P fed by the feeding roller 3 and the feeding driven roller 4 to a position opposite to a print head 7. A pinch roller 6 applies a bias force toward the conveying roller 5 and sandwiches the sheet P between the pinch roller 6 and the conveying roller 5 to generate a feeding force.

The print head 7 ejects ink in yellow, magenta, cyan, and black. A carriage 50 is a carriage on which the print head 7 is mounted and which moves in a direction intersecting the sheet conveying direction. Movement of the carriage 50 allows the print head 7 to scan the sheet P and to eject the ink to the print sheet P conveyed by the conveying roller 5 and a pinch roller 6 for printing. In the printing, a platen 8 supports a back surface of the print sheet P at a position opposite to the print head 7.

A discharge roller 9 discharges the print sheet P printed by the print head 7 to the exterior of the apparatus. At the time of the discharge, spurs 62 and 63 rotate in contact with a print surface of the print sheet printed by the print head 7. In this case, the spur 63 located downstream of the spur 62 is biased by the discharge roller 9. On the other hand, the discharge roller 9 is not disposed at a position opposite to the spur 62 located upstream of the spur 63. The spur 62 prevents the print sheet P from being raised.

Figure 7:
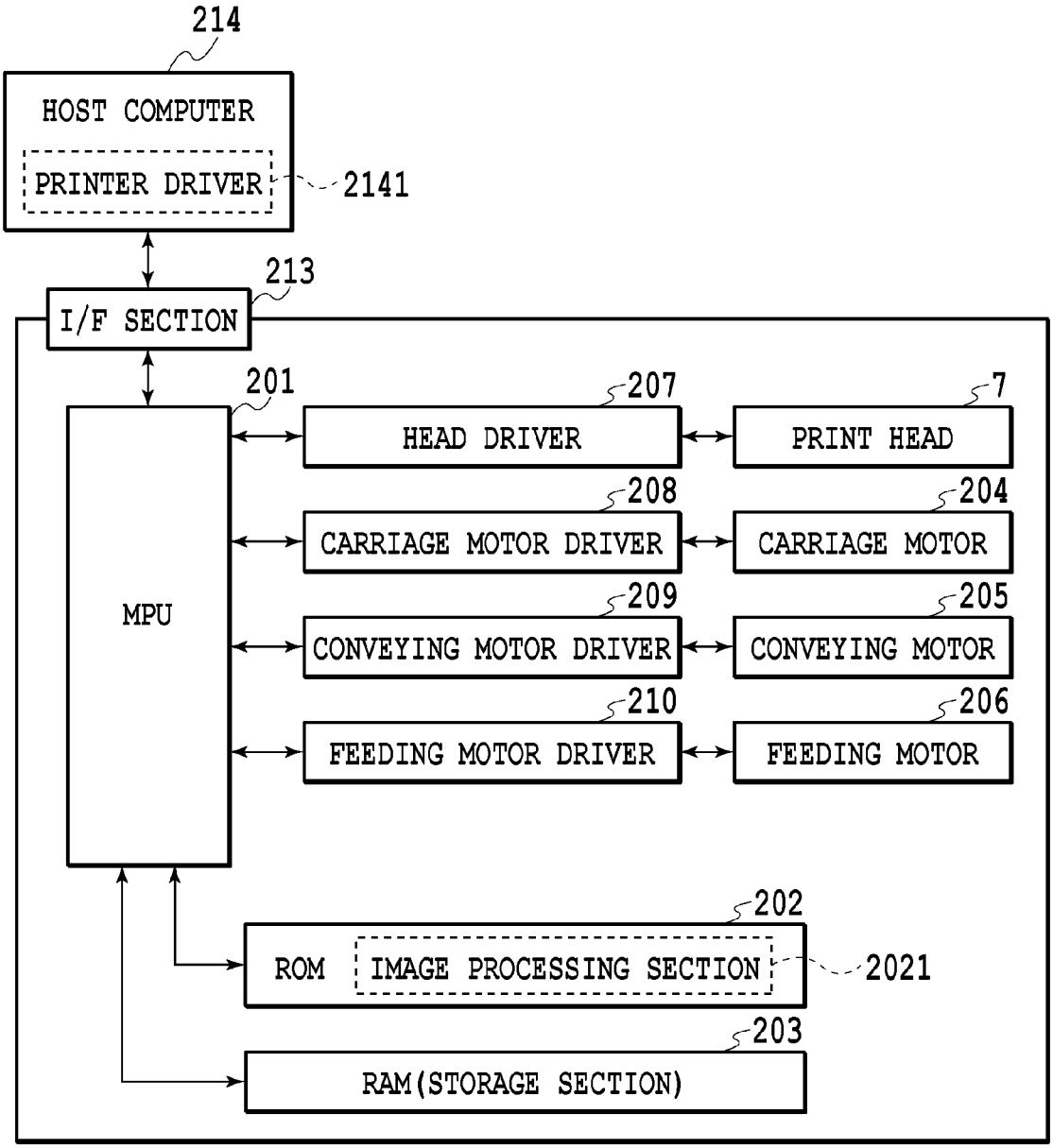
FIG. 7 is a block diagram showing a control configuration for the printing apparatus shown in FIG. 6.

FIG. 7 is a block diagram showing a general configuration of the printing apparatus of the present embodiment. In FIG. 7, an MPU 201 controls operations of the sections and data processing. A ROM 202 stores programs and data executed by the MPU 201. A RAM 203 temporarily stores processing data executed by the MPU 201 and data received from a host computer 214.

A head driver 207 drives the print head 7 to eject the ink. A carriage motor driver 208 controls driving of a carriage motor 20 serving as a driving source for movement of the carriage 50. A conveying motor driver 209 controls driving of a conveying motor 205 that is a driving source for the conveying roller 5 and the discharge roller 9. A feeding motor driver 210 controls driving of a feeding motor 206 that is a driving source for the pickup roller 21 and the feeding roller 3.

When a user orders execution of a printing operation in a host computer 214, a printer driver 2141 transmits print images and print information such as print image grades to the printing apparatus. The MPU 201 performs the printing operation based on the print information received from the host computer 214 via an I/F section.

Figure 8:
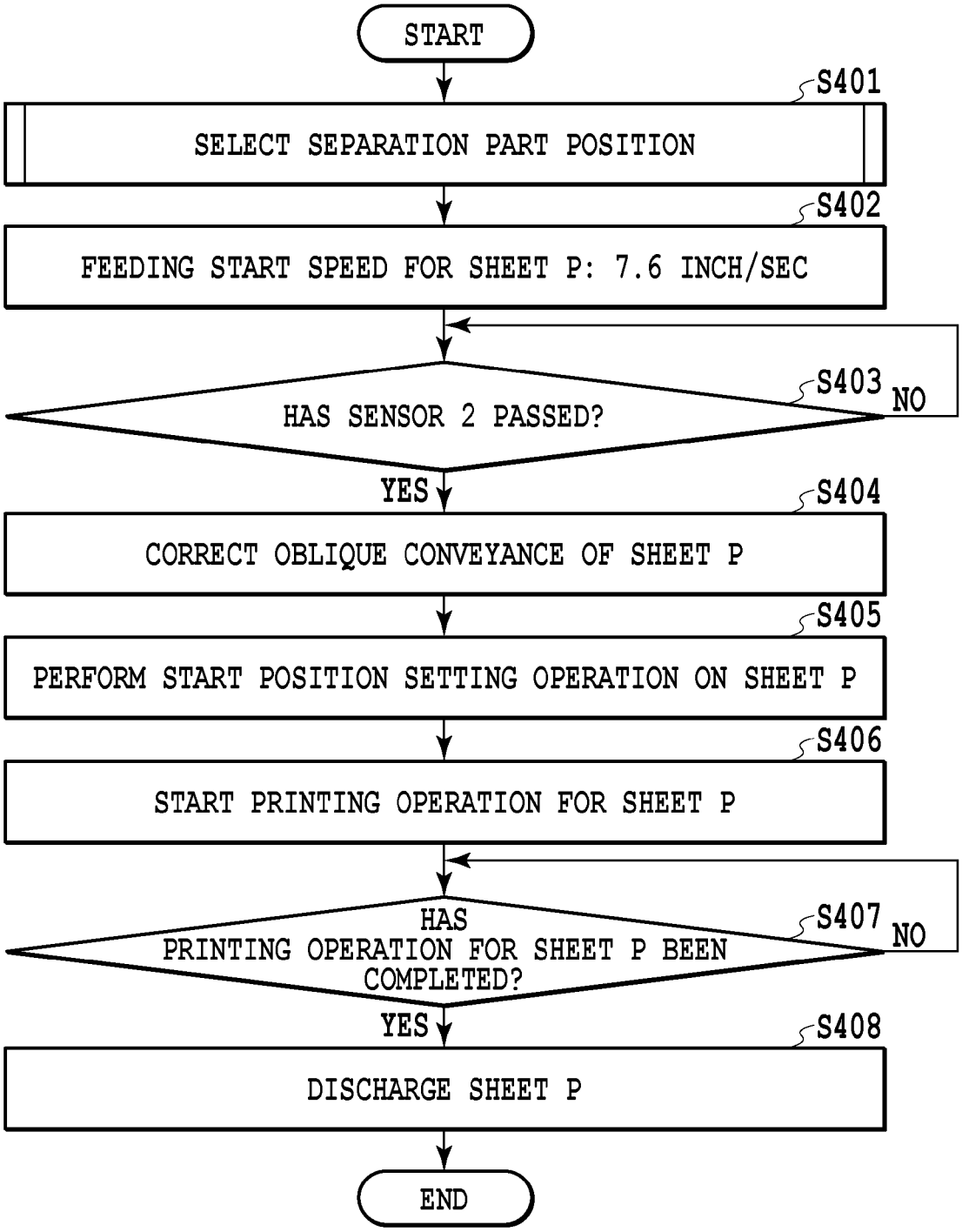
FIG. 8 is a flowchart illustrating a printing operation including a sheet feeding operation in the printing apparatus according to the embodiment of the present invention.

FIG. 8 is a flowchart illustrating a printing operation including a sheet feeding operation in the printing apparatus of the present embodiment. First, in step S401, the position of the main separation part 32 is selected. This position selecting operation is an operation of selectively switching between a state where the main separation part 32 protrudes from the separation slope 31 as shown in FIG. 4A (position A) and a state where the separation part 32 retracts from the separation slope 31 as shown in FIG. 4B (position B).

Figure 9:
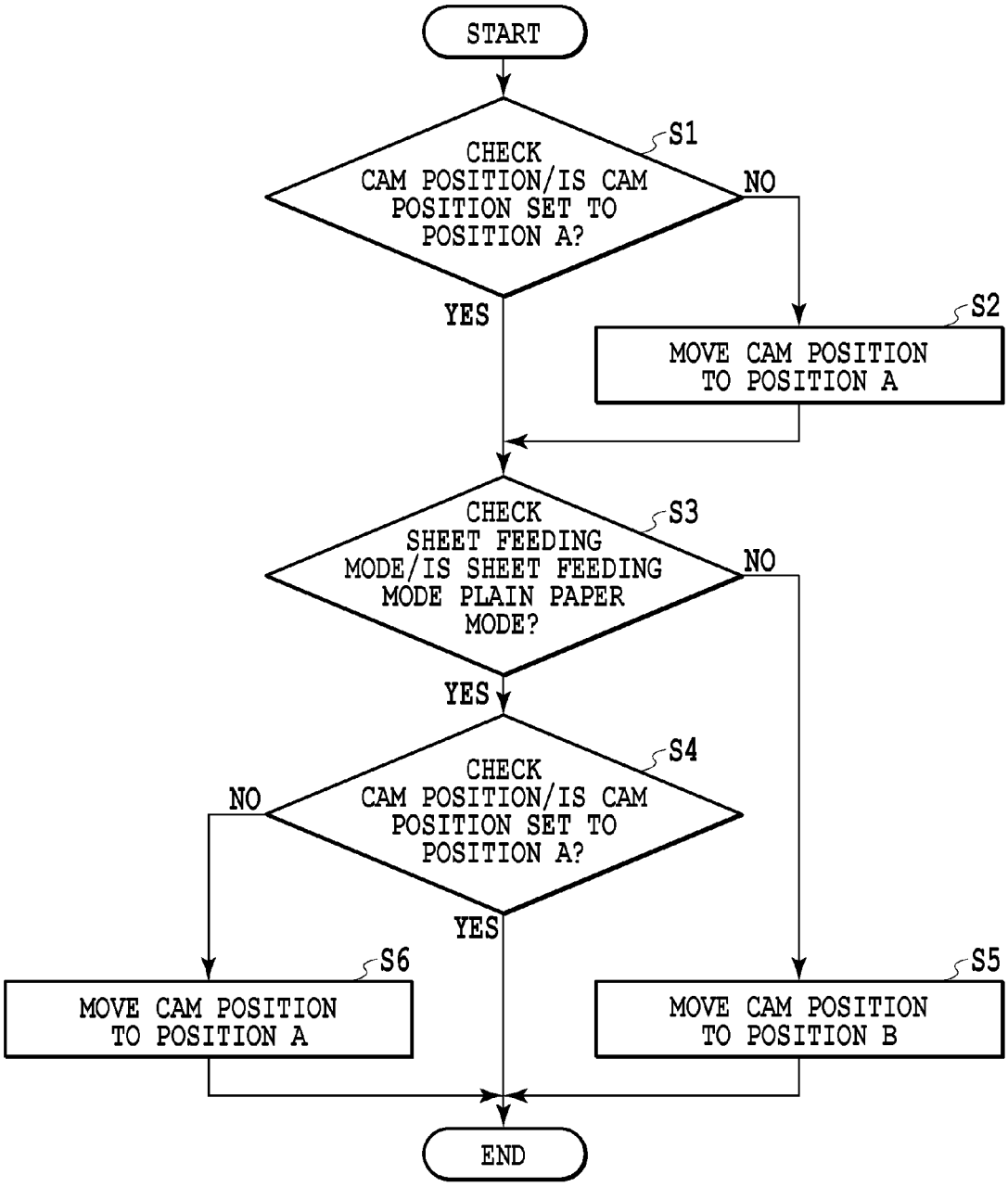
FIG. 9 is a flowchart illustrating details of a position selecting operation illustrated in FIG. 8.

FIG. 9 is a flowchart illustrating details of the position selecting operation. First, in step S1, the process determines whether or not the main separation part 32 is in a position A that is an initial position. When the main separation part 32 is not in the position A, the process proceeds to step S2 to drive the cam shaft 34 to move the main separation part 32 to the position A. Then, in step S3, a sheet feeding mode is checked based on information from the host computer 214. When the sheet feeding mode is a plain paper mode, the process proceeds to step S4 to determine again whether or not the main separation part 32 is in the position A. Upon determining, in step S3, that the sheet feeding mode is not the plain paper mode, the process proceeds to step S5 to move the main separation part 32 to a position B. When the process determines, in step S4, that the main separation part 32 is not in the position A, then in step S6, the main separation part 32 is moved to the position A. As described above, the position of the main separation part 32 is selected.

As seen again in FIG. 8, in step S402, the pickup roller 21 is rotated at a predetermined speed, 7.6 inch/sec in the present embodiment. Thus, the pickup roller 21 rotates to pick up the sheet P, and the feeding roller 3 feeds the sheet P toward the print head 7. In step S403, the sheet detection sensor 2 detects the leading end of the sheet P. Then, in step S404, the amount of rotation of the feeding roller 3 is controlled to bring the leading end of the sheet P into abutting contact with a conveying nip portion. Thus, a positional-deviation correcting operation is performed. In step S405, a start position setting operation is performed on the sheet P. That is, the amount of rotation of the conveying roller 5 is controlled to convey the sheet P to a print start position with reference to the position of the conveying roller 5 based on the print data. In step S406, a printing operation is started in which the print head 7 ejects the ink to the sheet P. Specifically, the sheet P is printed by repeating a conveying operation and an image forming operation (ink ejecting operation); in the conveying operation, the sheet P is intermittently conveyed by the conveying roller 5, and in the image forming operation, the carriage 50 is moved to allow the print head 7 to scan, while the print head ejects the ink. When the process determines, in step S407, that the printing operation on the sheet P is complete, the sheet P is discharged to end the printing operation in step S408.

The separating operation for the sheet P in the sheet feeding apparatus of the printing apparatus according to the above-described present embodiment will be described with reference to FIGS. 10A to 16B.

Figure 10A:
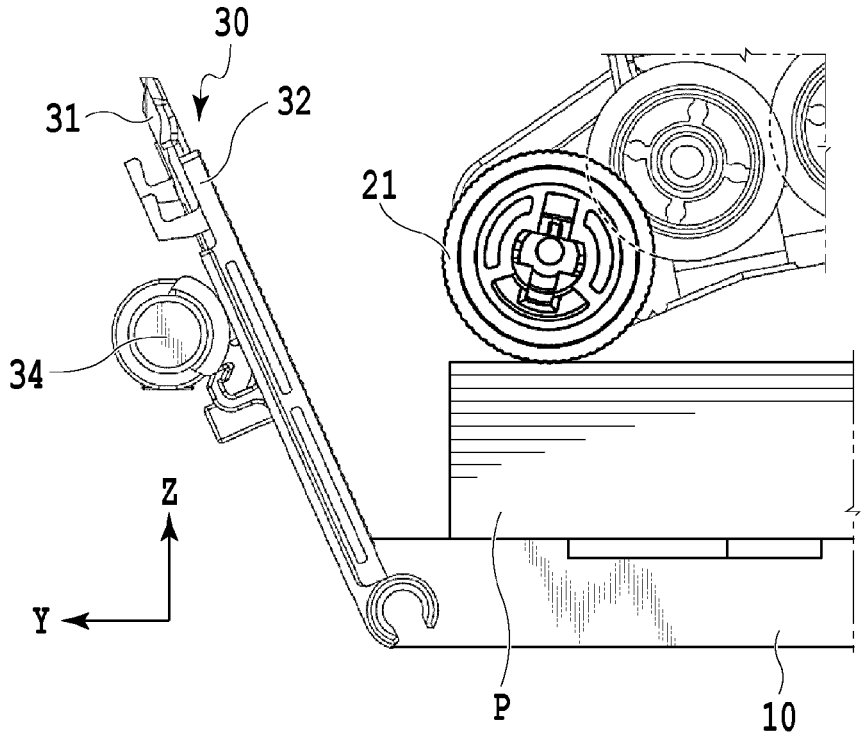
FIGS. 10A and 10B are diagrams illustrating a separating operation for stacked sheets in sheet feeding according to the embodiment of the present invention.
Figure 10B:
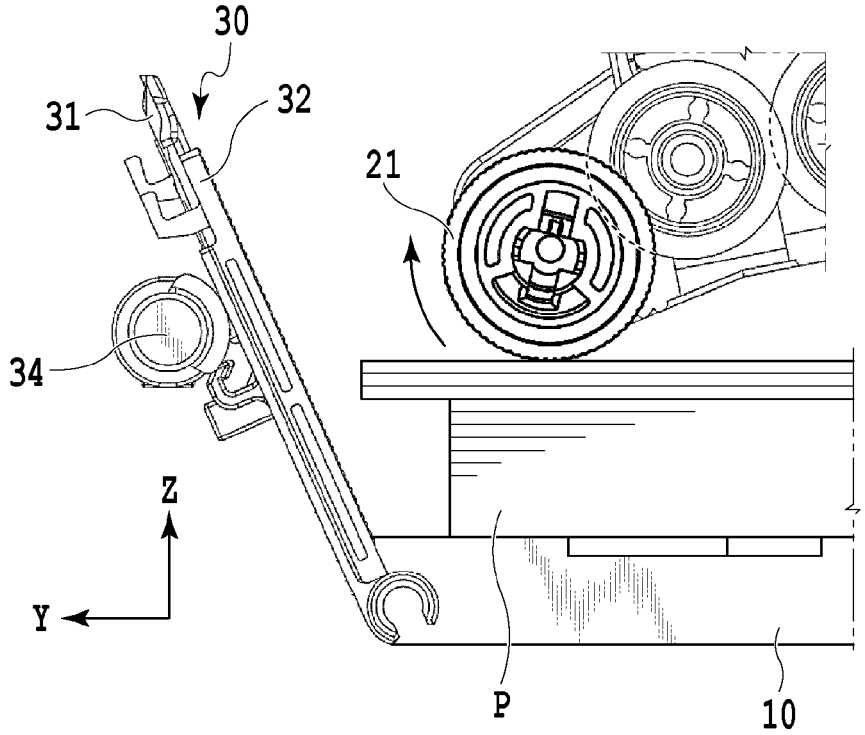

When the sheet P is plain paper with a low rigidity, the main separation part 32 is fixed by the cam shaft 34 so as to protrude from the separation slope 31, that is, in the position A as shown in FIG. 10A. When the pickup roller 21 is driven and rotated, several of the sheets P stacked in the cassette 10 which include the uppermost sheet are fed toward the separation section 30 as shown in FIG. 10B. At this time, the number of sheets P fed toward the separation section 30 is determined based on the state of a frictional force exerted between the sheets P at that time; the number may be one or two, or even ten or more.

Figure 11A:
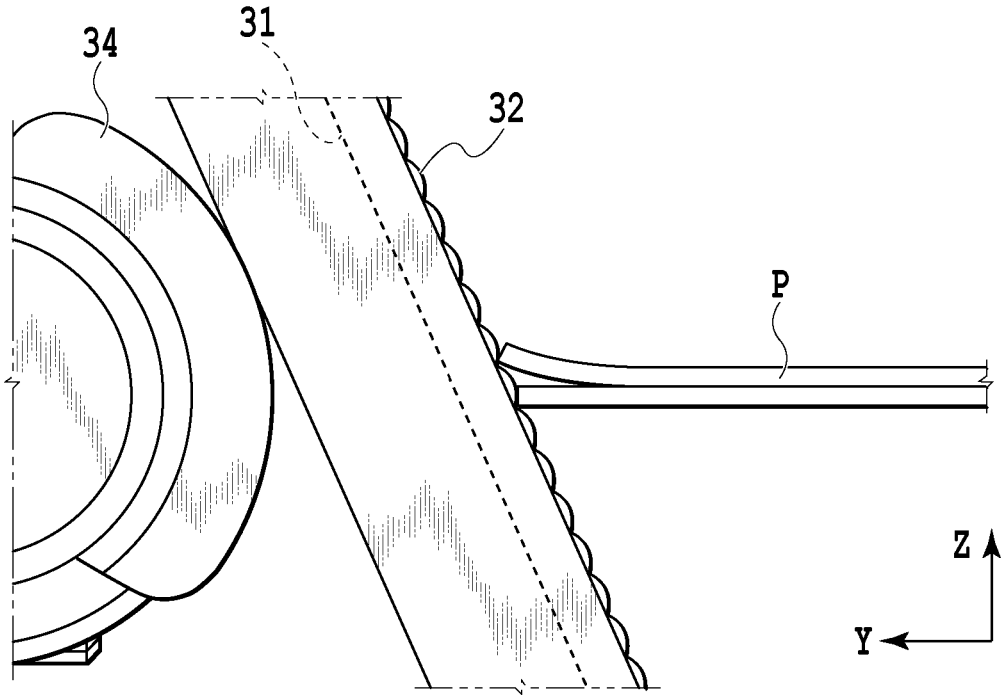
FIGS. 11A and 11D are also diagrams illustrating a separating operation for stacked sheets in sheet feeding according to the embodiment of the present invention.
Figure 11B:
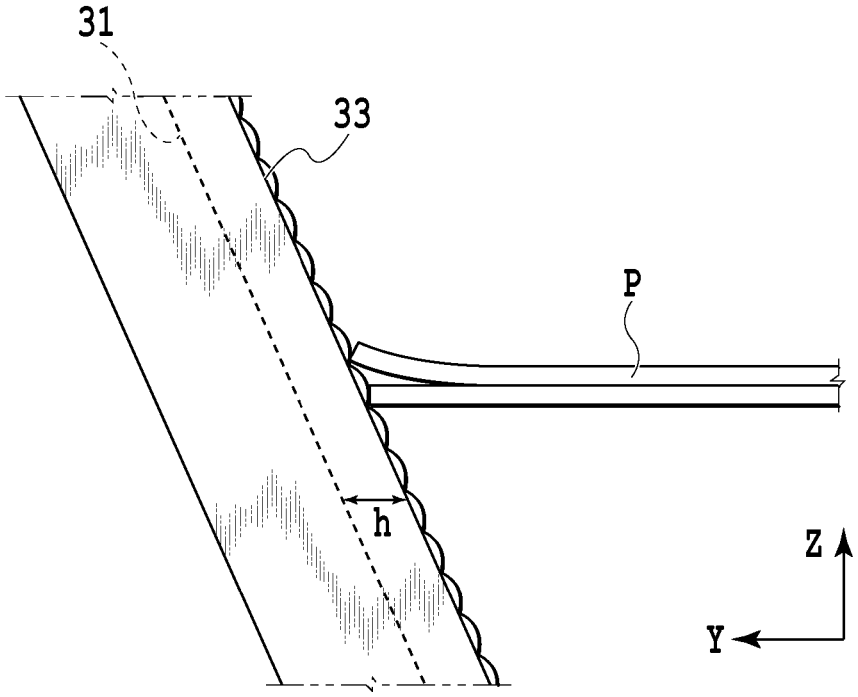

When the leading ends of the sheets P reach the separation section 30, the sheets P act as shown in FIGS. 11A, and 11B. When, for example, the leading ends of two sheets P reach the separation section 30, and moreover, in this state, the pickup roller 21 rotates to push the leading ends of the two sheets P into the separation section 30, the leading ends of the sheets P receive resistance from the main separation part 32 and the sub separation parts 33. At this time, the main separation part 32 is fixed by the cam shaft 34 so as to protrude from the separation slope 31 (a dashed line in FIG. 11A, represents the surface of the separation slope 31). Thus, the leading ends of the two sheets P reliably come into abutting contact with the main separation part 32 as shown in FIG. 11A. On the other hand, the sub separation parts 33, which are movable in the Y direction in the figures, are pushed in the Y direction in the figures. However, as shown in FIG. 11B, the sub separation parts 33 are kept at a distance "h" from the separation slope 31 which prevents the sub separation parts 33 from sinking into the separation slope 31, due to the balance between the bias force of the bias member biasing the sub separation parts 33 and not shown in the drawings and the push-in force of the two sheets (abutting contact force), and the leading ends of the two sheets P come into abutting contact with the sub separation parts 33 in this state. In other words, both the main separation part 32 and the sub separation parts 33 enable resistance to be applied to the leading ends of the two sheets P, thus exerting a force bending the sheets P on the leading ends of the sheets P. Consequently, the uppermost sheet P is deformed and separated from the other sheets.

Figure 12A:
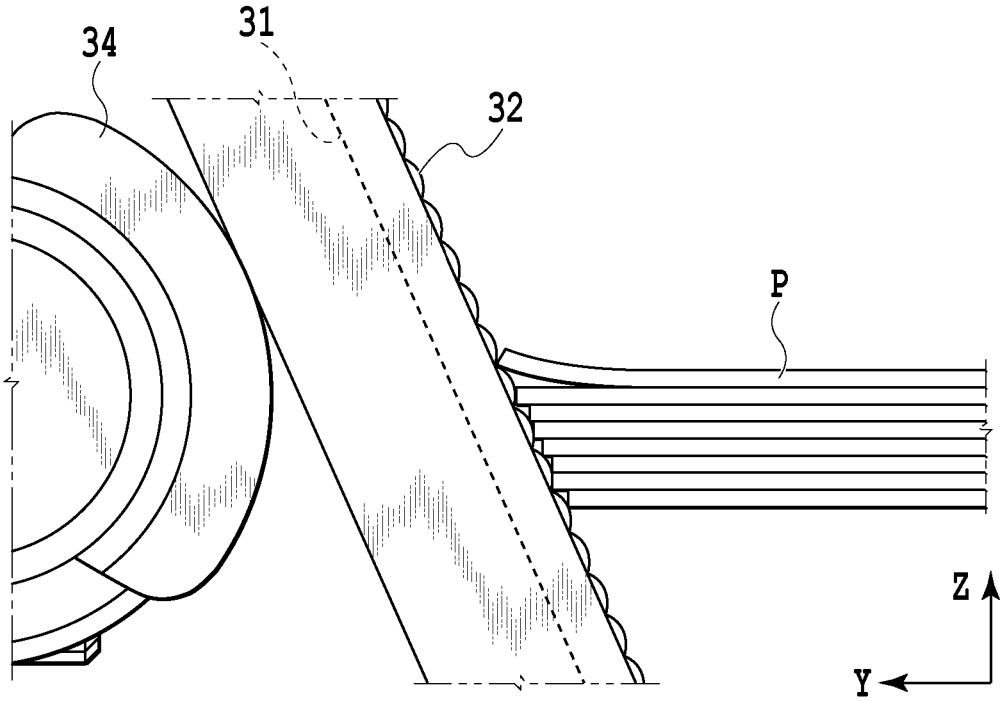
FIGS. 12A and 12B are also diagrams illustrating the separating operation for the stacked sheets in the sheet feeding according to the embodiment of the present invention.
Figure 12B:
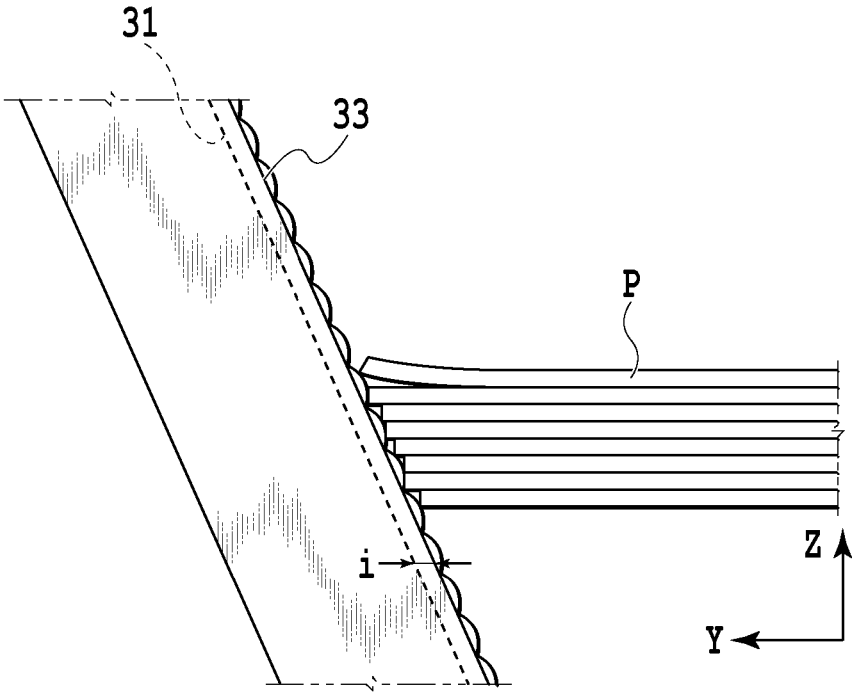

When the leading ends of more sheets, appropriately 10 sheets P, reach the separation section 30, the sheets P act as shown in FIGS. 12A, and 12B. When, for example, the leading ends of 10 sheets P reach the separation section 30, and moreover the pickup roller 21 rotates to push the leading ends of two sheets P into the separation section 30, the leading ends of the sheets P receive resistance from the main separation part 32 and the sub separation parts 33. At this time, the main separation part 32 is fixed by the cam shaft 34 so as to protrude from the separation slope 31 (position A). Thus, the leading ends of the 10 sheets P reliably come into abutting contact with the main separation part 32 as shown in FIG. 12A. On the other hand, the sub separation parts 33, which are movable in the Y direction in the figures, are pushed in the Y direction in the figures. However, the fixed main separation part 32 limits movement of the leading ends of the ten sheets P. Thus, as shown in FIG. 12B, the sub separation parts 33 are kept at a distance "i" (<h) from the separation slope 31 which prevents the sub separation parts 33 from sinking into the separation slope 31, and the leading ends of the 10 sheets P come into abutting contact with the sub separation parts 33 in this state. In other words, as is the case with the two sheets, both the main separation part 32 and the sub separation parts 33 enable resistance to be applied to the leading ends of the 10 sheets P, thus exerting a force bending the sheets P on the leading ends of the sheets P. Consequently, the uppermost sheet P is deformed and separated from the other sheets.

Figure 13A:
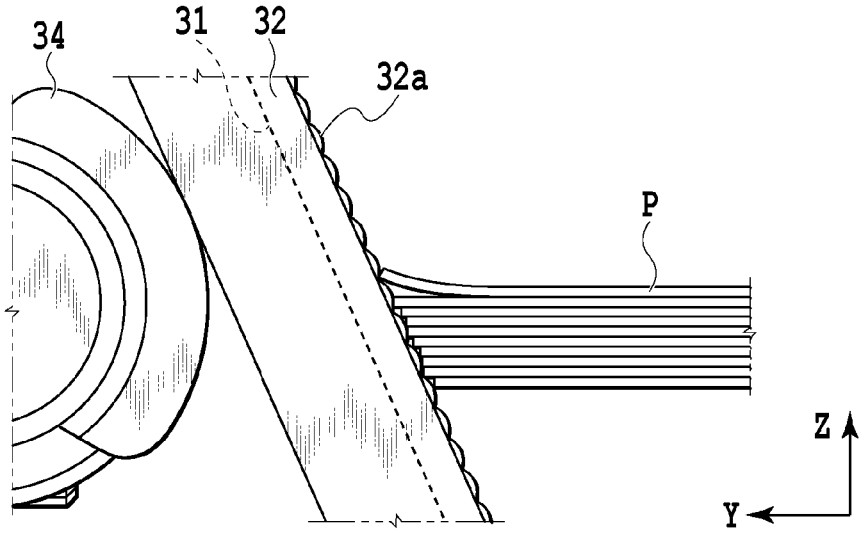
FIGS. 13A to 13C are also diagrams illustrating the separating operation for the stacked sheets in the sheet feeding according to the embodiment of the present invention.
Figure 13B:
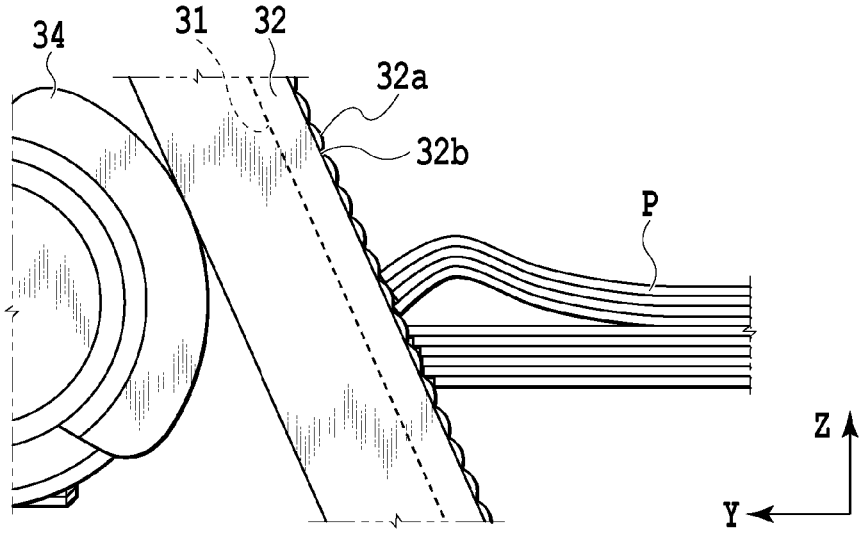
Figure 13C:
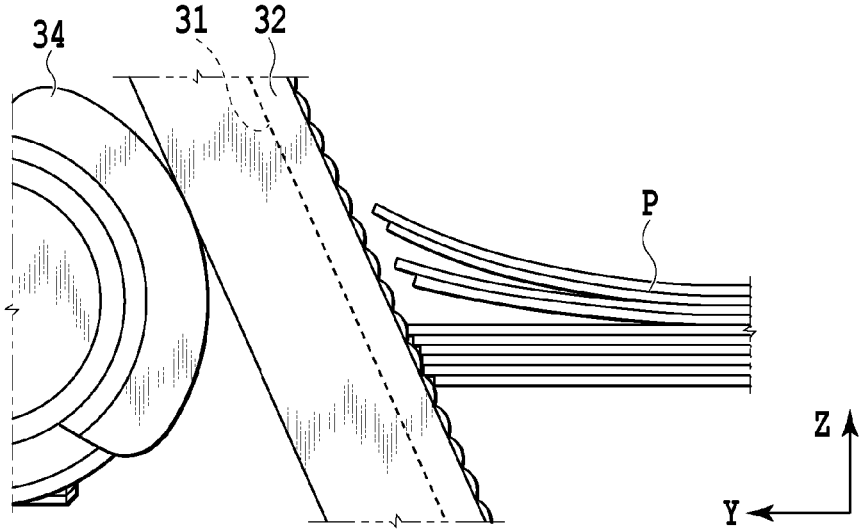

Now, a variation in the behavior of paper when a plurality of sheets P come into abutting contact with the main separation part 32 will be described in conjunction with associated effects of the sub separation parts 33. A case will be described where the leading ends of 10 sheets P reach the separation section 30. When the leading ends of 10 sheets P reach the separation section 30, and moreover the pickup roller 21 rotates to push the leading ends of the 10 sheets P into the separation section 30, the leading ends of the sheets P receive resistance from the main separation part 32 and the sub separation parts 33. Since the main separation part 32 is fixed by the cam shaft 34 so as to protrude from the separation slope 31, in an ideal state, the leading ends of the sheets P are conveyed while sliding on the protruding portions 32*a* of the main separation part 32. At this time, the leading ends of the sheets P receive the desired resistance from the main separation part 32, and thus, the uppermost sheet P is deformed and separated from the other sheets. However, since the main separation part 32 is fixed, an instantaneous excessive reaction force (impact force) may be applied to the leading ends of the sheets P. At this time, the sheets P may be deformed before the leading ends of the sheets P slide on the protruding portions 32*a* and the valley portions 32*b* of the main separation part 32 as shown in FIG. 13B. In this case, the leading ends of the sheets P fail to receive the desired resistance needed for separation, thus from a state shown in FIG. 13B to a state shown in FIG. 13C, the leading ends of the sheets P apparently jump up and down and the plurality of sheets is conveyed without being separated from one another.

Figure 14A:
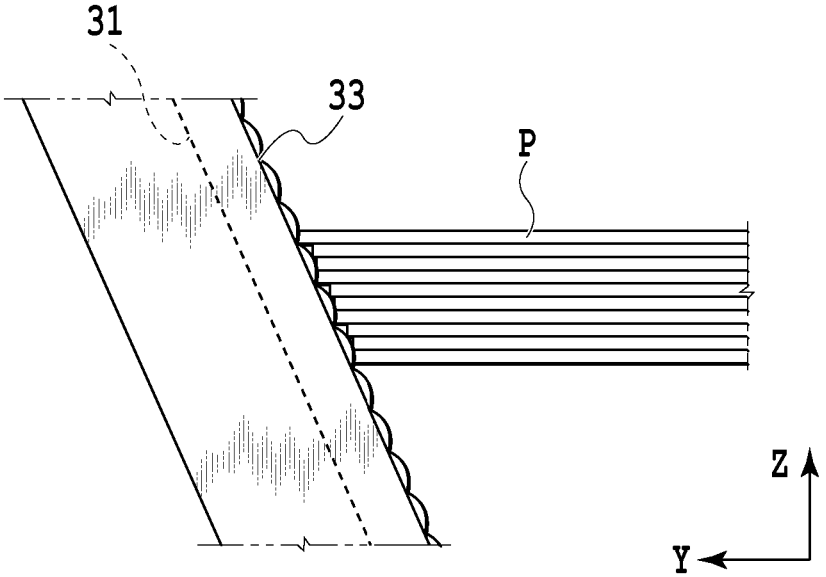
FIGS. 14A and 14B are also diagrams illustrating the separating operation for the stacked sheets in the sheet feeding according to the embodiment of the present invention.
Figure 14B:
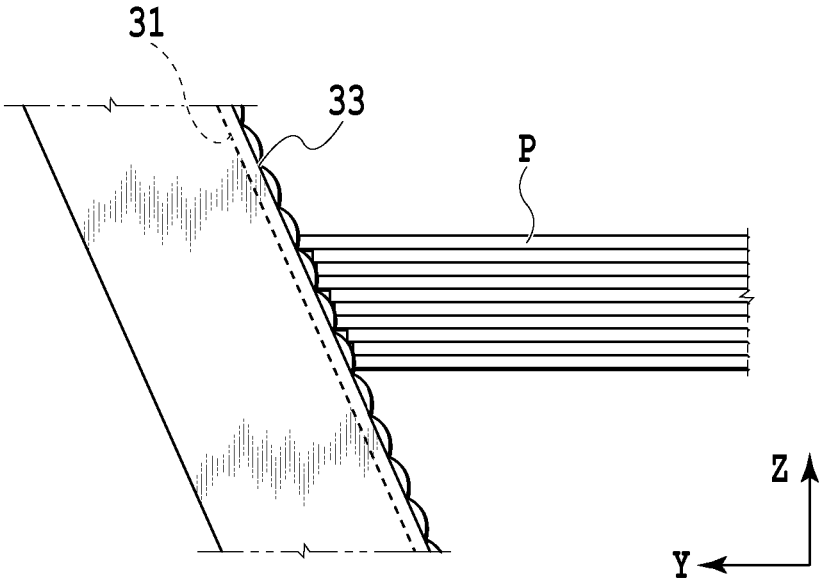
Figure 15A:
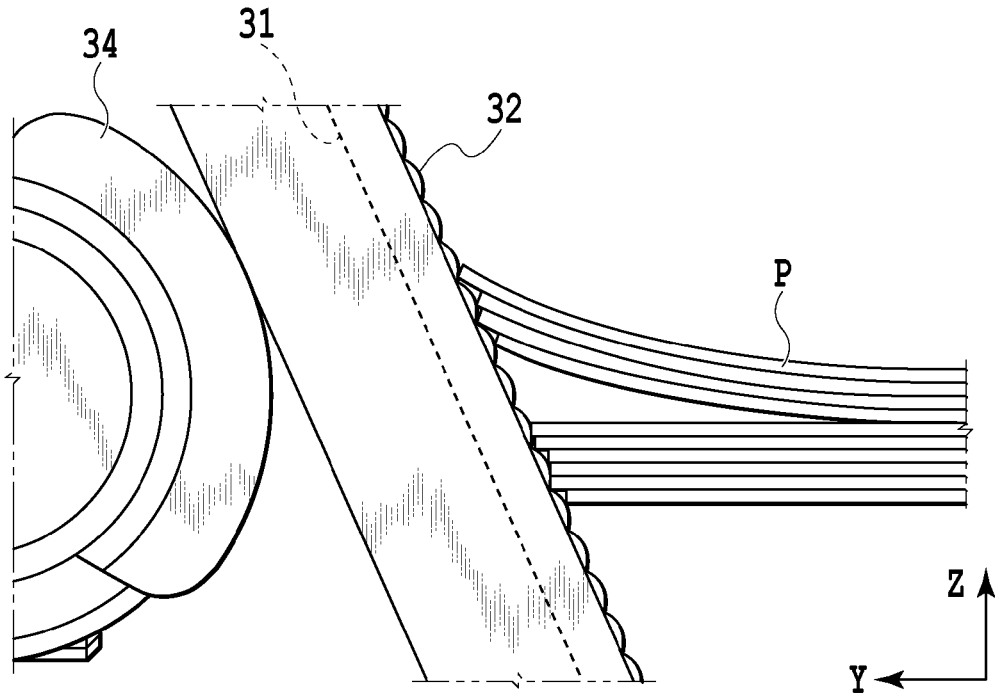
FIGS. 15A and 15B are also diagrams illustrating the separating operation for the stacked sheets in the sheet feeding according to the embodiment of the present invention.
Figure 15B:
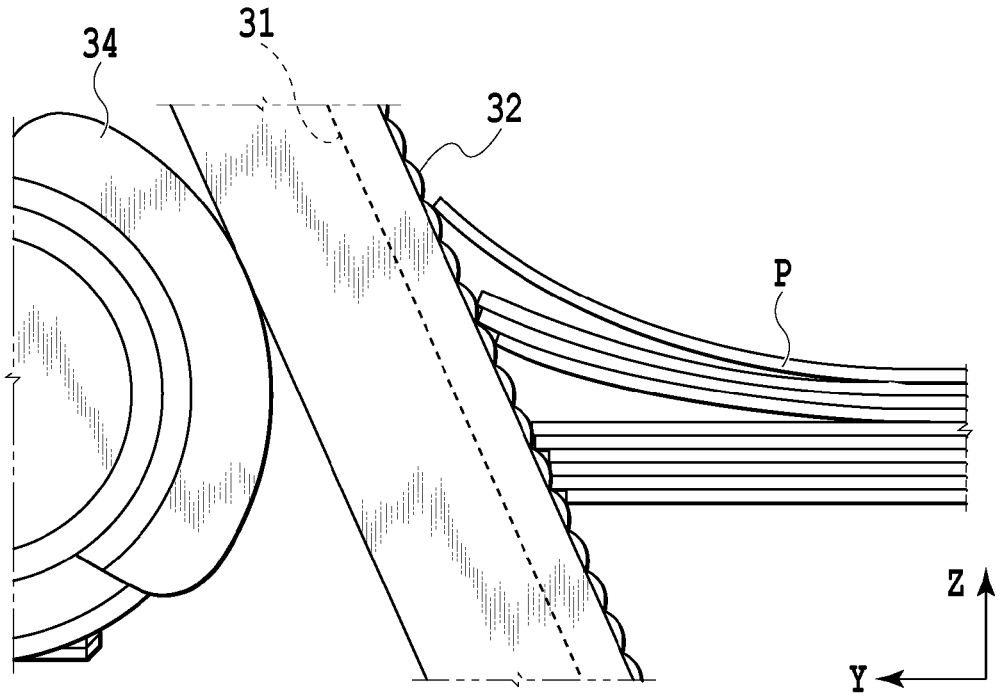

In contrast, the sub separation parts 33, which are movable in the Y direction in the figures, are pushed in the Y direction in the figures from a state shown in FIG. 14A to a state shown in FIG. 14B. Thus, the above-described instantaneous excessive reaction force (impact force) acting on the leading ends of the sheets P is relieved by the sub separation parts 33. As a result, while the leading ends of the sheets P jump up and down on the main separation part 32, the protruding portions 33*a* and the valley portions 33*b* of the sub separation parts 33 allow the leading ends of the sheets P to be held. The holding of the leading ends of the sheets P by the sub separation parts 33 minimizes the jump of the leading ends of the sheets P. Thus, as shown in FIG. 15A, the leading ends of the plurality of sheets P come into abutting contact with the main separation part 32 again. That is, the main separation part 32 and the sub separation parts 33 each act to allow resistance to be applied to the leading ends of the sheets P, thus exerting a force bending the sheets P on the leading ends of the sheets P, and the uppermost sheet P is deformed and separated from the other sheets. Furthermore, in the width direction of the sheets P, the pickup roller 21 is provided only on one side of each of the sub separation parts 33 as shown in FIG. 2. Consequently, the force by which the sheets push in the sub separation parts 33 can be prevented from being excessively high. Thus, the sub separation parts 33 can be more appropriately restrained from being pushed in by the sheets P, allowing the leading ends of the sheets P to be more reliably held.

If the sub separation parts 33 are fixed by the cam shaft 34 similarly to the main separation part 32, a phenomenon occurs where the leading ends of the sheets P jump up and down, leading to overlap feeding of the sheets P. Even if the fixed sub separation parts 33 enable the leading ends of the sheets P to be held so as to prevent the leading ends from jumping up and down, the pickup roller 21 applies only a weak binding force to the sheets P near the sub separation part 33, resulting in a significant difference between a time when the uppermost sheet P leaves the sub separation part 33 and a time when the uppermost sheet P leaves the main separation part 32. As a result, the sheets P are more significantly deformed in the width direction, and the ends of the sheets P are likely to be folded, leading to the high likelihood of a jam. Thus, desirably, the sub separation parts 33 are movable in the Y direction in the figures, and are biased to the position where the sub separation parts 33 protrude from the separation slope 31 in the standby state, by the bias force applied, in the −Y direction in the figures, by the bias member not shown in the drawings.

Figure 16A:
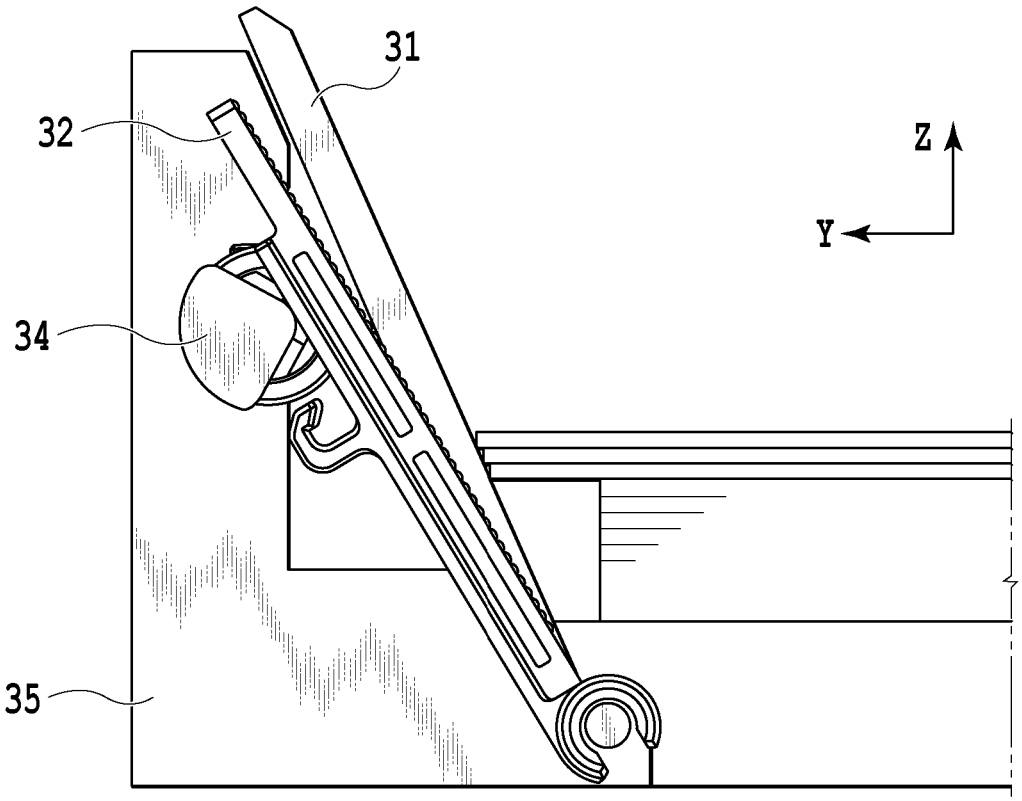
FIGS. 16A and 16B are also diagrams illustrating the separating operation for the stacked sheets in the sheet feeding according to the embodiment of the present invention.
Figure 16B:
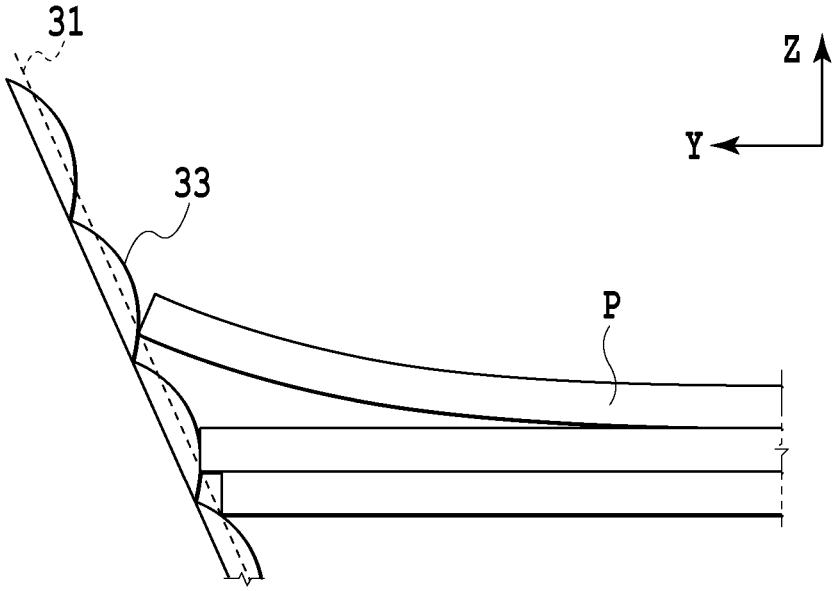

Now, a sheet separating operation performed when the sheets P are photo paper or the like, which has high rigidity, will be described. When the sheets P are photo paper or the like, which has high rigidity, the main separation part 32 is fixed by the cam shaft 34 so as not to protrude from the separation slope 31 but to retract from the separation slope 31 (position B) as shown in FIG. 16A. Thus, the leading ends of the sheets P come into abutting contact only with the separation slope 31 and the sub separation parts 33. The separation slope 31 is set to an angle of 60 to 70 degrees so as to apply the desired resistance needed for separation to the leading ends of the sheets P such as photo paper, which has high rigidity. However, the leading ends of the actual sheets P may be curled or have burrs formed during cutting, and thus the simple uniform angle setting may lead to a failure in the separation of the sheets P, resulting in overlap feeding or non-feeding. As shown in FIG. 16B, the sub separation parts 33 hold the leading ends of the sheets P using the protruding portions 33*a*, while applying resistance to the leading ends of the sheets P by the bias force of the bias member not shown in the drawings. Consequently, the leading ends of the sheets P are unsusceptible to the curls or the burrs formed during cutting, and the resistance needed for separation can be stably applied to the leading ends of the sheets P. In other words, the sub separation parts 33 serve to exert a force bending the sheets P on the leading ends of the sheets P, causing the uppermost sheet P to be deformed and separated from the other sheets.

In the above-described configuration, the main separation part 32 is provided substantially opposite to the pickup roller 21 so as to correspond substantially to the center of the sheet in the sheet width direction, and the two sub separation parts 33 are provided in the areas of the separation section 30 which are different from the area substantially opposite to the pickup roller 21 in the sheet width direction. However, the present invention is not limited to this configuration, and for example, the embodiment configured as described above may be additionally provided with a further sub separation part 33 at a position away from the center of the sheet in the sheet width direction. In particular, the sub separation part 33 is added so as to deal with a larger sheet width to enable reliable separation to be achieved for the larger sheet size.

In the above-described configuration, the plurality of protruding portions 33*a* is contiguously disposed on the surface of the sub separation part 33 in the sheet feeding direction, and the sub separation parts 33 as a whole are movable in the Y direction in the figures with respect to the separation slope base 35. However, the plurality of protruding portions 33*a* that allow the leading ends of the sheets P to be held may be provided so as to be movable with respect to the fixed separation section (for example, the separation slope 31). Furthermore, when a plurality of protruding portions 33*a* is provided so as to be elastically deformable, the protruding portions 33*a* themselves have the function of the sub separation parts 33, and this form is included in the present invention.

As described above, the above-described embodiment allows the resistance needed for separation to be appropriately applied to sheets with different levels of rigidity, thus providing a sheet feeding apparatus that achieves reliable separation.

Another Embodiment

Figure 17:
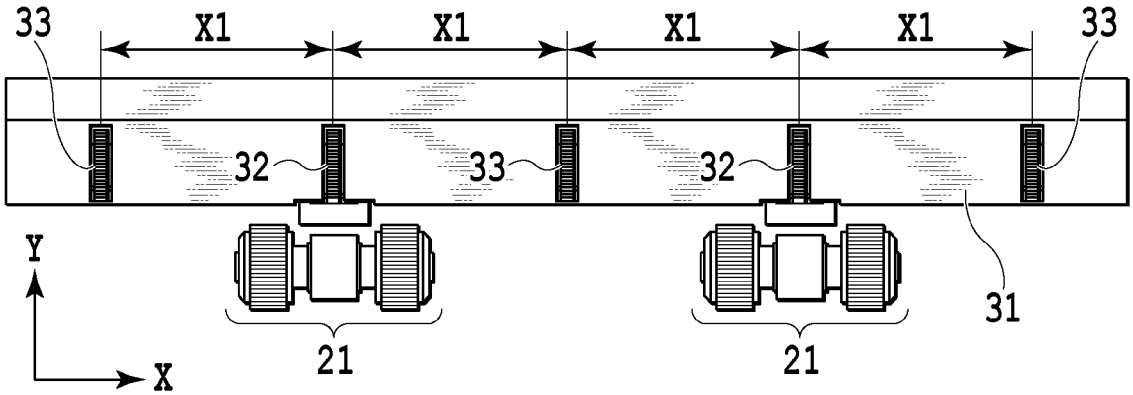
FIG. 17 is a diagram showing a sheet feeding apparatus according to a modification of the first embodiment.

FIG. 17 is a diagram showing a sheet feeding apparatus according to a modification of the above-described first embodiment. Mainly, to effectively deal with large sheet sizes, the sheet feeding section has two pickup rollers 21 arranged in the sheet width direction. Main separation parts 32 are provided opposite the respective pickup rollers 21. As indicated in the first embodiment, each of the main separation parts 32 is configured to enable its orientation to be changed and to enable switching between a state where the main separation part 32 protrudes from the separation slope 31 (position A) as shown in FIG. 4A and a state where the main separation part 32 retracts from the separation slope 31 (position B) as shown in FIG. 4B. Sub separation parts 33 are provided in areas of the separation slope 31 that are different from the areas opposite to the pickup rollers 21. The sub separation parts 33 are provided on the right and left of each of the main separation parts 32 at a predetermined distance X1 from the main separation part 32. The sub separation part 33 provided between the two pickup rollers 21 is provided at the distance X1 from each of the two main separation parts 32. As shown in FIGS. 5A and 5B, the sub separation part 33 is movable in the Y direction in the figures along a guide portion 35*b* formed in the separation slope base 35 and is biased to the position where the sub separation part 33 protrudes from the separation slope 31 in the standby state, by the bias force applied, in the −Y direction in the figures, by a bias member not shown in the drawings. The amount by which the sub separation parts 33 protrude at this time is the same as the amount by which the main separation parts 32 protrude.

The above-described configuration allows the separation section to be configured to deal with large sheet sizes, providing a sheet feeding apparatus that achieves reliable separation.

Yet Another Embodiment

The above-described embodiment relates to the form in which the separation section with the separation slope (separation surface), the main separation part, and the sub separation parts is provided in the cassette forming the main body of the sheet feeding apparatus. However, the application of the present invention is not limited to this form. For example, the separation section may be provided in a part of the printing apparatus which is adjacent to the cassette in which sheets are stored.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170342, filed Aug. 25, 2014, which is hereby incorporated by reference wherein in its entirety.

What is claimed is:

1. A sheet feeding apparatus comprising:

a feeding unit configured to feed a sheet by coming into contact with an uppermost sheet of a plurality of stacked sheets;

a separation surface configured to be contacted by the sheet fed by the feeding unit to separate the sheet;

a first separation part, provided separate from the separation surface, and configured to be switched between a first position in which the first separation part protrudes from the separation surface and the sheet is capable of contacting the first separation part and a second position in which the first separation part is retracted from the separation surface and the sheet is not capable of contacting the first separation part;

a fixing unit configured to selectively fix the first separation part at the first position or the second position so that the first separation part is not moved between the first position and the second position as a result of a contact force which the first separation part receives from the sheet; and a second separation part, provided separate from the separation surface, and configured to be movable in a first direction from a condition in which the second separation part protrudes from the separation surface and the sheet is capable of contacting the second separation part to a condition in which the second separation part is retracted from the separation surface, the movement by a contact force which the second separation part receives from the sheet, and the second separation part configured to be biased in a second direction opposite to the first direction.

2. The sheet feeding apparatus according to claim 1, further comprising a printing unit configured to perform printing to the fed sheet.

3. The sheet feeding apparatus according to claim 1, further comprising a cassette in which a plurality of sheets are stacked and wherein the separate surface is provided on the cassette.

4. The sheet feeding apparatus according to claim 1, wherein the feeding unit feeds the sheet using a pickup roller, the first separation part is disposed on an opposite portion opposed to the pickup roller in a feeding direction of the sheet and the second separation part is disposed on a portion except the opposite portion in the feeding direction of the sheet.

5. The sheet feeding apparatus according to claim 1, wherein the fixing unit fixes the first separation part to the first position when feeding a sheet having a predetermined rigidity and fixes the first separation part to the second position when feeding a sheet having a rigidity higher than the predetermined rigidity.

6. The sheet feeding apparatus according to claim 1, wherein a plurality of the second separation parts are disposed symmetrically with respect to the first separation part as a center of arrangement in a width direction of the sheet.

7. The sheet feeding apparatus according to claim 1, wherein the first and second separation parts are provided with protruding portions continuously in the feeding direction on the respective surfaces.

8. The sheet feeding apparatus according to claim 7, wherein each of the continuously disposed protruding portions in the feeding direction has a circular-arc-shape.

* * * * *